US006362787B1

(12) United States Patent
Judd et al.

(10) Patent No.: US 6,362,787 B1
(45) Date of Patent: Mar. 26, 2002

(54) LIGHTNING PROTECTION FOR AN ACTIVE ANTENNA USING PATCH/MICROSTRIP ELEMENTS

(75) Inventors: Mano D. Judd, Rockwall, TX (US); Thomas D. Monte, Lockport, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/483,648

(22) Filed: Jan. 14, 2000

Related U.S. Application Data

(63) Continuation-in-part of application No. 09/299,850, filed on Apr. 26, 1999, which is a continuation-in-part of application No. 09/422,418, filed on Oct. 21, 1999.

(51) Int. Cl.[7] ..... H01Q 21/24
(52) U.S. Cl. ..... 343/700 MS
(58) Field of Search ..... 343/700 MS, 824, 343/749, 751, 752, 872

(56) References Cited

U.S. PATENT DOCUMENTS

| | | | | |
|---|---|---|---|---|
| 4,124,852 A | | 11/1978 | Steudel | 343/854 |
| 4,360,813 A | | 11/1982 | Fitzsimmons | 343/100 |
| 4,566,013 A | | 1/1986 | Steinberg et al. | 343/372 |
| 4,689,631 A | | 8/1987 | Gans et al. | 343/781 |
| 4,825,172 A | | 4/1989 | Thompson | 330/124 R |
| 4,849,763 A | | 7/1989 | DuFort | 342/372 |
| 4,890,110 A | | 12/1989 | Kuwahara | 342/35 |
| 5,034,752 A | | 7/1991 | Pourailly et al. | 342/373 |
| 5,061,939 A | * | 10/1991 | Nakase | 343/700 MS |
| 5,230,080 A | | 7/1993 | Fabre et al. | 455/15 |
| 5,248,980 A | | 9/1993 | Raguenet | 342/354 |
| 5,280,297 A | | 1/1994 | Profera, Jr. | 343/754 |
| 5,327,150 A | | 7/1994 | Cherrette | 343/771 |
| 5,379,455 A | | 1/1995 | Koschek | 455/273 |
| 5,412,414 A | | 5/1995 | Ast et al. | 342/174 |
| 5,513,176 A | | 4/1996 | Dean et al. | 370/18 |
| 5,548,813 A | | 8/1996 | Charas et al. | 455/33.3 |
| 5,596,329 A | | 1/1997 | Searle et al. | 342/374 |
| 5,604,462 A | | 2/1997 | Gans et al. | 330/124 R |
| 5,619,210 A | | 4/1997 | Dent | 342/352 |
| 5,621,422 A | * | 4/1997 | Wang | 343/895 |
| 5,644,622 A | | 7/1997 | Russell et al. | 455/422 |
| 5,646,631 A | | 7/1997 | Arntz | 342/373 |
| 5,659,322 A | | 8/1997 | Caille | 342/188 |
| 5,710,804 A | | 1/1998 | Bhame et al. | 379/58 |
| 5,714,957 A | | 2/1998 | Searle et al. | 342/374 |
| 5,724,666 A | | 3/1998 | Dent | 455/562 |
| 5,751,250 A | | 5/1998 | Arntz | 342/373 |
| 5,770,970 A | | 6/1998 | Ikeda | 330/286 |
| 5,802,173 A | | 9/1998 | Hamilton-Piercy et al. | 379/56.2 |
| 5,809,395 A | | 9/1998 | Hamilton-Piercy et al. | 455/4.1 |
| 5,832,389 A | | 11/1998 | Dent | 455/562 |
| 5,854,611 A | | 12/1998 | Gans et al. | 342/373 |
| 5,862,459 A | | 1/1999 | Charas | 455/114 |
| 5,987,335 A | * | 11/1999 | Knoedl, Jr. et al. | 455/561 |
| 6,008,763 A | * | 12/1999 | Nystrom et al. | 343/700 MS |
| 6,043,790 A | | 3/2000 | Derneryd et al. | 343/853 |
| 6,072,434 A | * | 6/2000 | Papatheodorou | 343/700 MS |
| 6,091,360 A | | 7/2000 | Reits | 342/368 |
| 6,104,935 A | | 8/2000 | Smith et al. | 455/562 |
| 6,140,976 A | | 10/2000 | Locke et al. | 343/853 |

FOREIGN PATENT DOCUMENTS

| | | | |
|---|---|---|---|
| WO | WO 95/34102 | 12/1995 | H01Q/1/38 |
| WO | WO 98/09372 | 3/1998 | H03F/1/32 |
| WO | WO 98/11626 | 3/1998 | H01Q/23/00 |
| WO | WO 98/50981 | 11/1998 | H01Q/3/40 |

* cited by examiner

*Primary Examiner*—Don Wong
*Assistant Examiner*—James Clinger
(74) *Attorney, Agent, or Firm*—Wood, Herron & Evans, L.L.P.

(57) ABSTRACT

An active antenna system having lightning, corona and low frequency static energy protection includes a plurality of patch antenna elements, a feed structure operatively interconnecting the patch antenna elements, and at least one conductive drain line coupled with each of the patch antenna elements. The drain lines are coupled together at a common ground connection point.

38 Claims, 9 Drawing Sheets

LIGHTNING PROTECTION FOR AN ACTIVE ANTENNA USING PATCH/MICROSTRIP ELEMENTS

CROSS-REFERENCE TO RELATED APPLICATION

This application is a continuation-in-part of U.S. application Ser. No. 09/299,850, filed Apr. 26, 1999 entitled "Antenna Structure and Installation" and U.S. Application Ser. No. 09/422,418, filed Oct. 21, 1999 entitled "Transmit/Receive Distributed Antenna Systems".

FIELD OF THE INVENTION

This invention is directed generally to the field of antennas for communication systems, and more particularly to a novel active antenna system using patch/microstrip antenna elements, and more particularly still, to a novel lightning, corona, and low frequency static energy protection scheme for such an antenna system.

BACKGROUND OF THE INVENTION

In base stations for most Cellular/PCS systems, where the antennas and cable are completely passive, lightning near strikes (or other corona discharges or high energy static) cause reliability concerns, since the antenna acts as a "sponge" to the lightning (or corona/static discharge) energy, and channels the high voltage to the sensitive electronics. Of course, in the case of direct strikes, the antenna system is typically vaporized. However, for near strikes, where the local area around the antenna is saturated with high voltage field energy, protection of the base station electronics from this energy is warranted. These systems often employ "lightning arrestor" systems, often simply high voltage-capable capacitors (high pass filters), that suppress the low frequency and DC (direct current) energy associated with the lightning. These arrestors are often simply attached in series with the cable to the antenna, near the antenna and/or near the base of tower (as shown in FIG. 1), via connectors, to the RF cable.

Additionally, even the presence of simple static build-up (DC energy), on the surface of the antenna elements, can achieve significant voltage to severely damage active components, not protected by the conventional lightning arrestor described above, i.e., a high voltage capacitor in series with the cable.

The above-referenced prior applications discloses a novel active amplifier system in which patch or microstrip type antenna elements are arranged in antenna arrays with each antenna element being provided with a low power amplifier chip closely adjacent the antenna element, or at least within the same housing or on the same circuit board as the antenna element.

For such "active" antenna systems, which employ active electronics (amplifiers, transistors, phase shifters, . . . ) within the antenna structure, the use of the above-described conventional lightning arrestors will not protect the electronics. Such protection would require an arrestor system or device within the antenna itself, to arrest the low frequency and DC energy before it reaches any electronics. This proves difficult, since conventional arrestor devices are typically large (an inch or more in diameter) and costly. Additionally, the use of an arrestor of this type can adversely impact the performance of the electronics, since the capacitive properties of the arrestor adversely affects the circuit impedance.

OBJECTS AND SUMMARY OF THE INVENTION

The invention is described herein in connection with an aperture coupled microstrip patch antenna used in a base station sector antenna with active electronics; however, the invention is not so limited, but may be used in connection with patch antenna elements in other applications. Typically, the radiating microstrip patch is located on a dielectric superstrate and the DC voltage of the (metal) patch is floating with respect to zero potential or ground. If a static charge develops on the (metal) patch and discharges through the aperture to the microstrip feeder line, damage to, or failure of, the active electronics connected to the microstrip feeder line is possible. Since the antenna is operating with a single polarization, e.g., vertical polarization, any DC connection to the patch in the opposite polarization, e.g., horizontal polarization, does not affect the desired radiation pattern.

Therefore, to prevent static charge build up, the invention provides a narrow, high impedance conductive trace attached to the radiating patch in the orthogonal polarization (i.e., orthogonal to the patch polarization). These conductive traces are tied together with a vertical conductive trace along the axis of the array, which at a convenient location, is tied to an electrical ground.

In one embodiment, this grounding system of conductive traces is placed on the superstrate, so that the conductive traces do not disturb the base station's radiation pattern or VSWR (voltage standing wave ratio). For the case of vertical polarization of the antenna elements, if the vertical traces which tie together the individual narrow static (horizontal) drain lines are too close to the radiating patch (es), the radiating pattern and VSWR can degrade. Therefore, the vertical trace is separated from the radiating patch. In one example of the invention, the vertical trace is roughly 0.45 $\lambda o$ (0.45 of a free space wavelength) away from the edge of the radiating patch.

If only one (vertical) trace is used to connect to the (horizontal) lines from the patch, generation of some undesirable asymmetry in the azimuth radiation pattern is possible. By designing a system of traces with symmetry about the center of the radiating patch, in one embodiment of the invention, mechanical symmetry is maintained, and accordingly, the azimuth radiation pattern remains symmetrical.

In an alternate embodiment of the invention, it is an objective to overlay the grounding system of conductive traces on the superstrate so that the conductive traces interact with the radiating patch to produce desirable effects in overall (azimuth) radiation pattern. Some of the desirable effects to the (azimuth) radiation pattern are: (a) to suppress backward radiation, and, (b) shaping of the pattern within the sector coverage, i.e., tailoring the pattern to roll off quicker past the sector edge.

Briefly, in accordance with the foregoing, an active antenna system having lightning, corona and low frequency static energy protection, comprises a plurality of patch antenna elements, a feed structure operatively interconnecting said plurality of patch antenna elements, and at least one conductive drain line coupled with each of said patch antenna elements, said drain lines being coupled together at a common ground connection point.

DETAILED DESCRIPTION OF THE ILLUSTRATED EMBODIMENT

Figure 1:
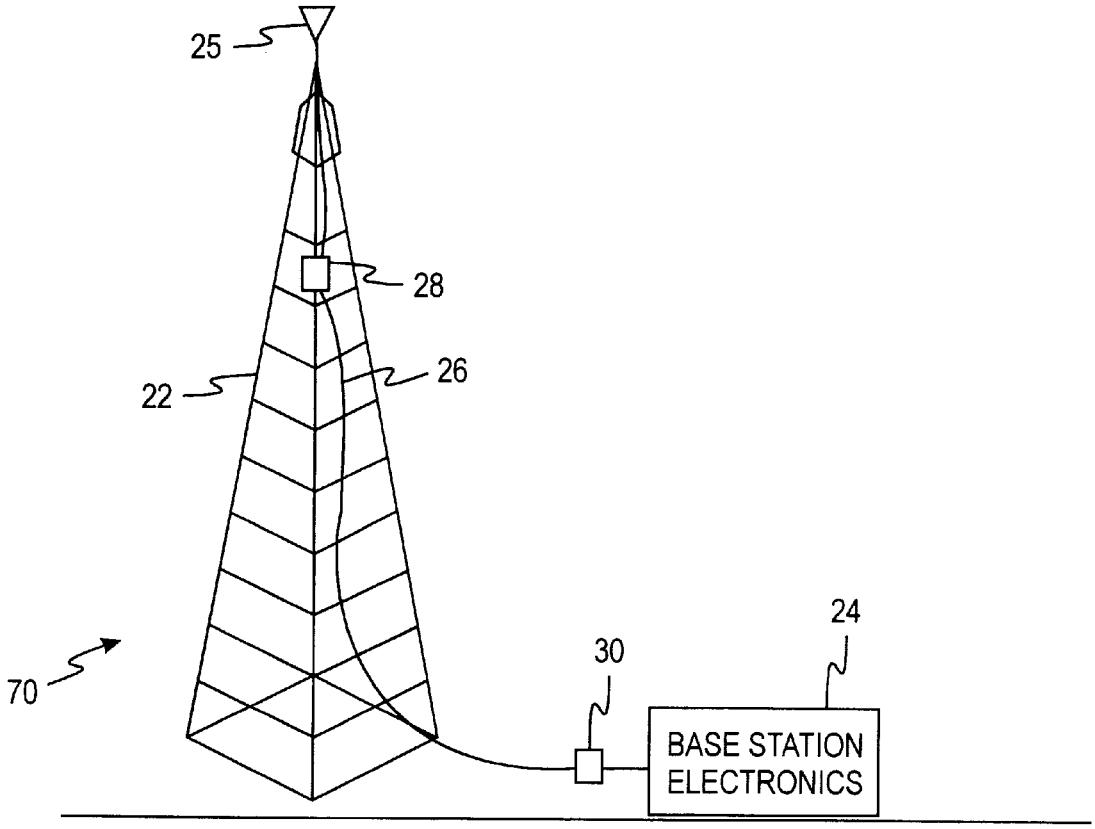
FIG. 1 Prior Art
FIG. 1 is a simplified showing of a tower-mounted passive antenna in accordance with the prior art.

FIG. 1 shows a conventional arrangement for a Cellular or PCS base station 20 having a tower 22 with a passive antenna 25 and ground-based electronics 24 connected to the antenna 25 by an RF cable 26. Lightning arrestor(s) 28, 30 are used either after the antenna at the tower top or at the base station, before the electronics, or both. Typically, the arrestors 28, 30 are high voltage capacitors wired in series with the RF cable 26. This prevents low frequency or DC current, associated with the absorbed corona energy, from a near miss lightning strike, from traveling through the RF coaxial cable into the base station electronics.

Figure 2:
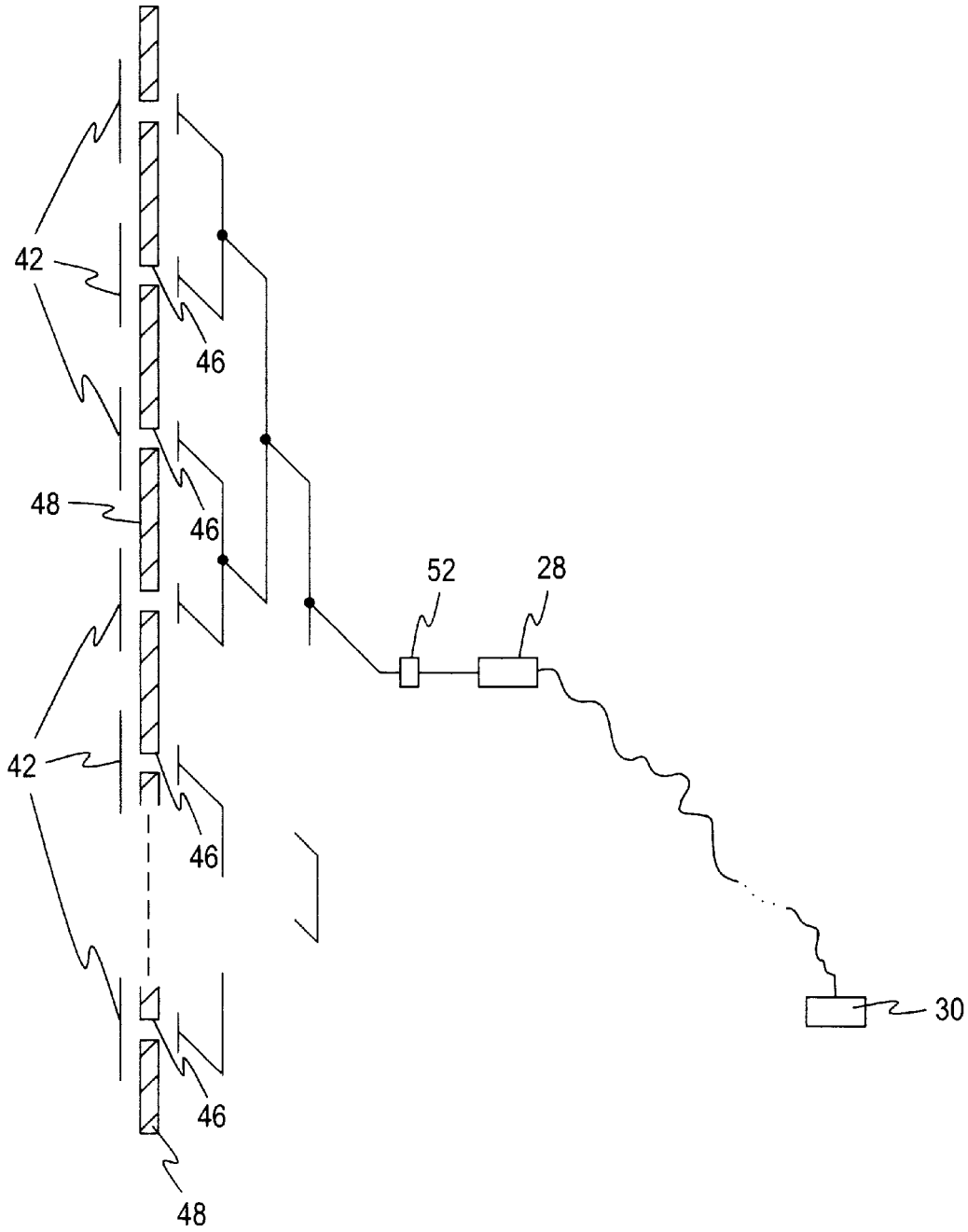
FIG. 2 is a simplified side elevation, partially in section, of a patch antenna system using aperture coupling in accordance with the prior art.

FIG. 2 shows a side view, partially in section, of a typical patch antenna system 40, using an array of patch antenna elements (or "plates") 42 and aperture coupling of the patch antenna elements 42 to a corporate feed 44, at apertures (irises) 46 in a ground plane 48. However, the invention also applies to coaxial (cable) coupling techniques. The corporate feed 44 (shown here as a stripline structure) is shown in isometric view for ease of illustration. In a three-dimensional physical embodiment, the corporate feed would be in the same plane as the stripline coupling to the patches, etched on the same substrate (not shown in FIG. 2). The corporate feed could also be applied as a coaxial (cable) structure. The final feed output is connected to the coaxial cable 26 which traverses the tower 25 (FIG. 1) by a connector 52. At the top and base of the tower 25 are the conventional lightning arrestors 28, 30. As mentioned above, these are typically large series capacitors, which can handle extremely large voltages, and act to suppress DC and low frequency currents. Following the lightning arrestor 30 is the base station electronics 24, typically within a shelter (see FIG. 1), and comprised of amplifiers, transceivers, and modems.

Figure 3:
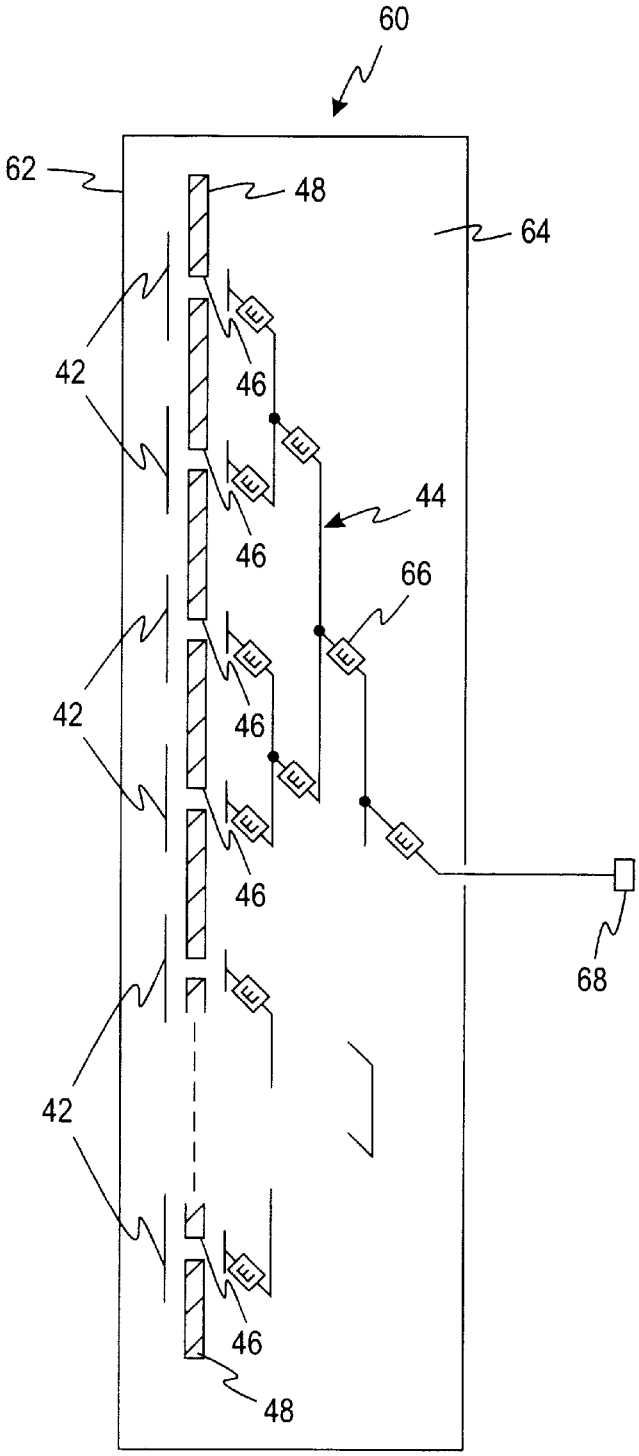
FIG. 3 is a side elevation, similar to FIG. 2, showing a patch antenna system similar to FIG. 2, but having electronic components at various stages of the corporate feed, in accordance with one embodiment of the invention.

FIG. 3 shows the antenna (array) arrangement of FIG. 2, indicated by like reference numerals, and further including an antenna housing 60 (e.g., a radome 62 plus a backplane/extrusion 64). The housing is shown in FIG. 3 as a simple rectangle; however, the actual radome and backplane can take various forms and shapes. Typically, the radome 62 is made from a dielectric material, and the backplane/extrusion 64 from a metallic material (such as aluminum). For a passive antenna system, the interaction and functionality of the housing is typically not considered, with respect to influences from lightning (corona discharge) and static build-up. However, FIG. 3 shows the general concept for an active antenna system in accordance with the invention. Here, active electronic components 66 (designated by "E") are shown at various stages of the corporate feed 44; directly after each antenna element 42 (directly at each feed point) and/or at various stages prior to a final input/output connector 68. This arrangement applies to transmit as well as receive antennas, or to antennas used as both transmit/receive antennas. The active components 66 can be any discrete device, or a number of discrete devices, IC's or circuits, such as amplifiers (devices or circuits), active phase shifters, RF power detectors, LNAs (Low Noise Amplifiers), etc.

The general problem in the case of such an active antenna arrangement, is that (DC or low frequency) high voltage fields can be absorbed (collected) on the patches or radiation/collection surfaces 42, and coupled to the microstrip transmission line 44, via the coupling aperture(s) (or iris) 46, in the same mode as the intended RF (high frequency) energy. Additionally, static (DC) energy can potentially build on the plates/patches 42, with period breakdown to the microstrip transmission lines 44. These energy sources can degrade or destroy the sensitive (typically low power) active components 66 at various stages on the transmission lines, and corporate feed 44.

Figure 4:
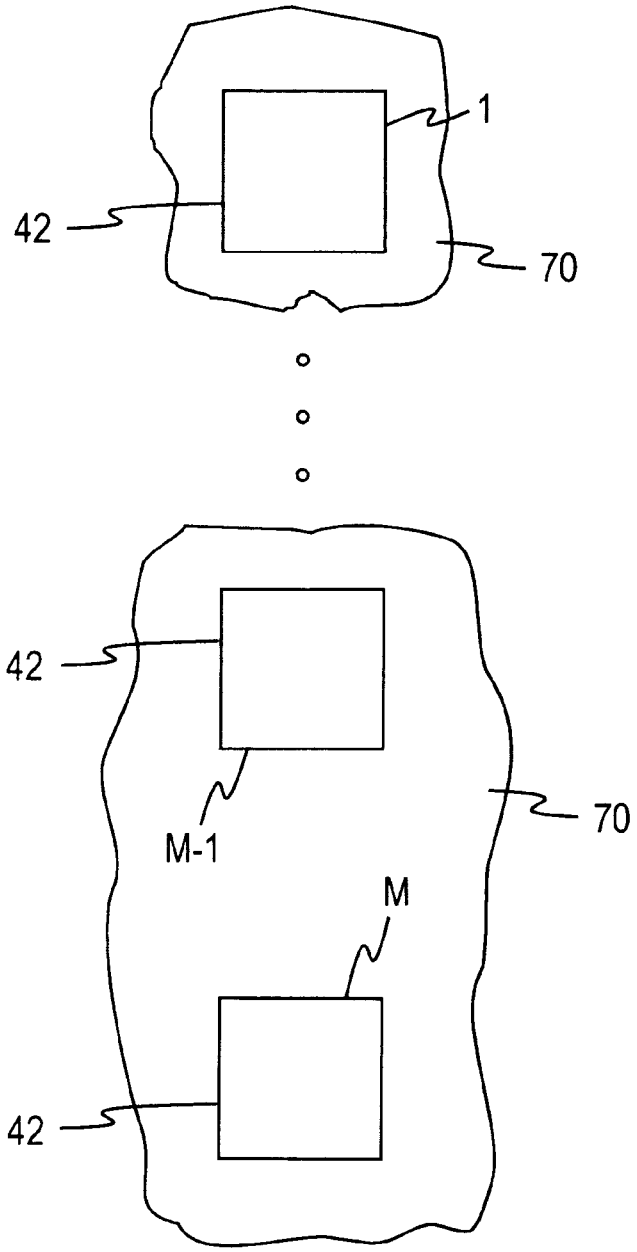
FIG. 4 is an elevation, partially broken away, showing a plurality of patch/microstrip antenna elements, for example, of the embodiment of FIG. 3.

FIG. 4 shows a plurality of patch/microstrip antenna elements 42, which comprise a typical antenna. The configuration shown is a single column of M antenna elements 42, however, this concept readily applies to a general (2-dimensional) M×N array of elements as well. These elements are typically etched on a dielectric substrate (or "superstrate") 70 located above the ground plane 48 containing the apertures 46 (not shown in FIG. 4) such as a floating printed circuit board (PCB) not directly connected to the ground plane 48 (i.e. an air gap between the two boards). This substrate 70 may be a PCB (printed circuit board).

Figure 5:
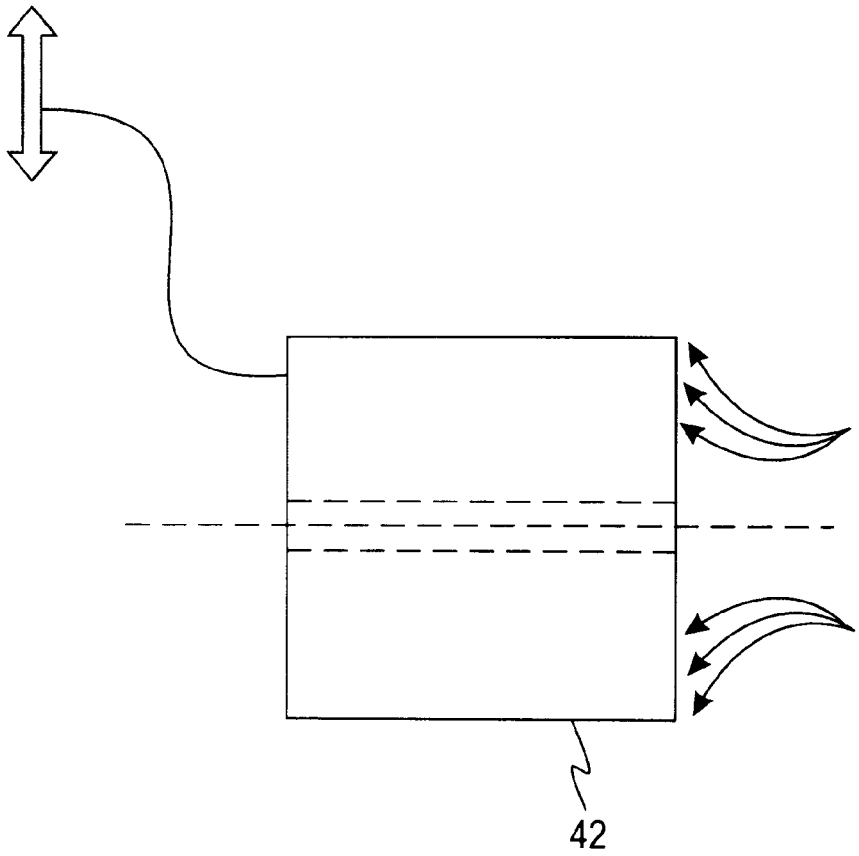
FIG. 5 is a simplified view of a single patch antenna element polarized in a vertical direction.

FIG. 5 shows a single patch antenna element 42, one of the elements from FIG. 4, with the polarization of the antenna element indicated as vertical by arrows 55. Therefore, the RF voltage is highest on the top and bottom of the patch 42. The RF voltage is near zero on the symmetry line (center) 45 of the patch, as shown in FIG. 5. In the area directly above and below the symmetry line, the RF voltage is low, and increases to a maximum (at the patch resonant frequency) towards the top and bottom of the patch. However, low frequency energy and DC energy (voltage) is fairly evenly distributed across the whole patch. Therefore, this energy can be tapped off at nearly any point on the patch. It will be apparent that the same considerations would apply for other polarization directions of the patch(es), e.g., horizontal, diagonal, etc.

Therefore, it is possible to tap off the low (or DC) frequency energy, and not significantly affect the RF functionality of the patch structure (i.e. tap off RF energy in an undesired manner), by connecting a tap or static drain line (microstrip line or coaxial line) at points/areas on or near the symmetry line 45 of the patch.

Figure 6:
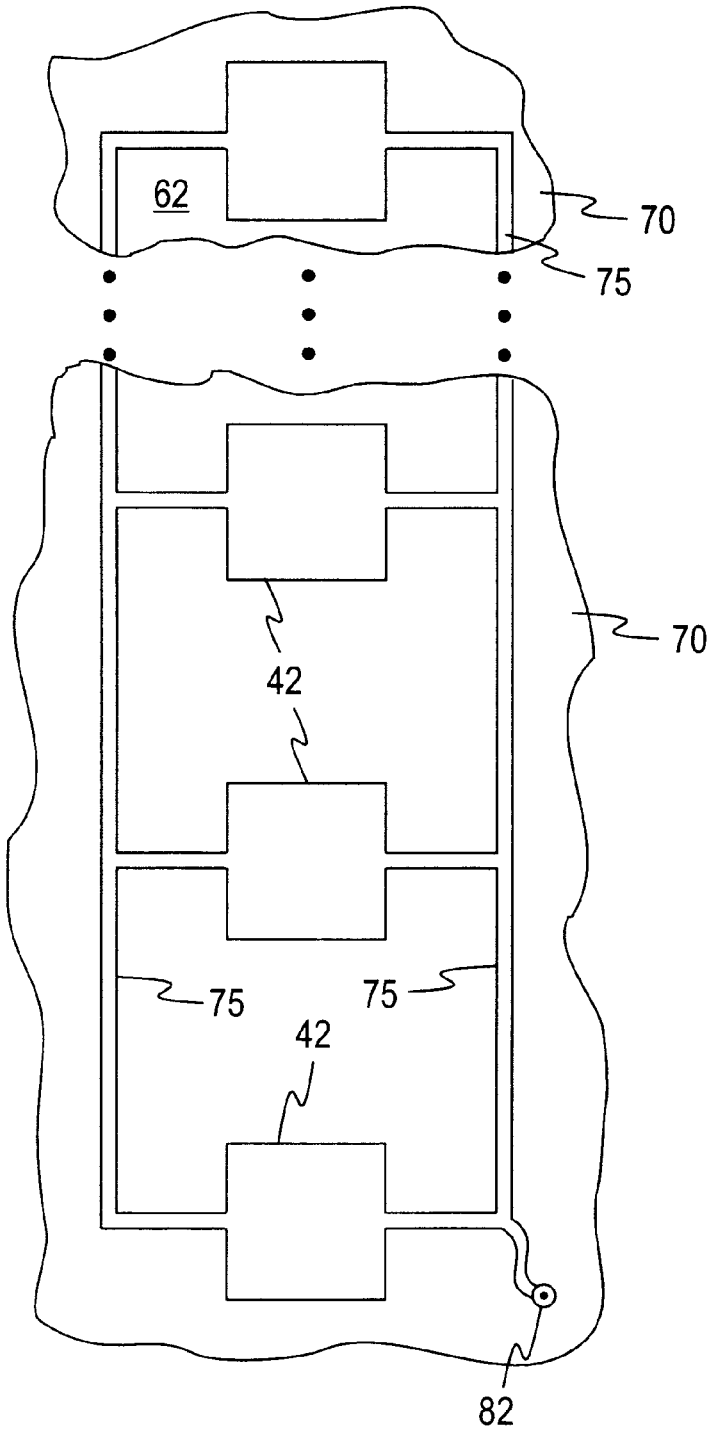
FIG. 6 is an elevation, similar to FIG. 4, showing a vertical array of patch antenna elements provided with static drain lines on both sides.

FIG. 6 shows one way to accomplish this. Metallic striplines (or coaxial lines) 75 are connected at the symmetry area of the patch and serve as static drain lines or taps. This diagram shows taps on both sides of the patch. This construction keeps the RF characteristics balanced, and does not "skew" the radiation pattern to right or left of the patch (in this case, does not rotate the azimuth pattern to one side or the other).

Figure 7:
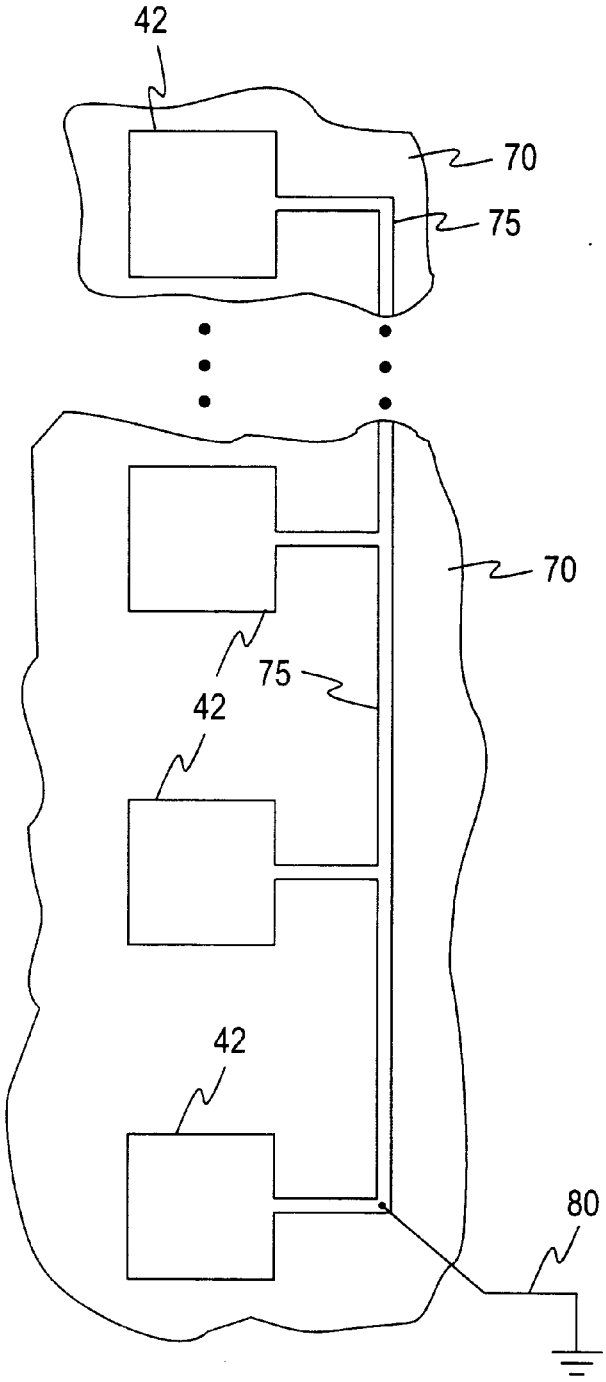
FIG. 7 is an elevation, similar to FIG. 6, showing static drain lines on one side of the patch antenna elements.

FIG. 7 shows the static drain lines 75 on one side only, and a wire 80 connected from the bottom right corner of the drain line 75, to ground. In this case, the ground can be the ground plane 48 with the apertures, or the backplane 64, or the (grounded) outer connector of the connector 52 or outer conductor of the coaxial cable 26 (to the base station). In this regard, FIG. 6 shows a connector or pin 82 on the dielectric substrate or PCB 70 which can be used to effect a similar ground connection.

Figure 8:
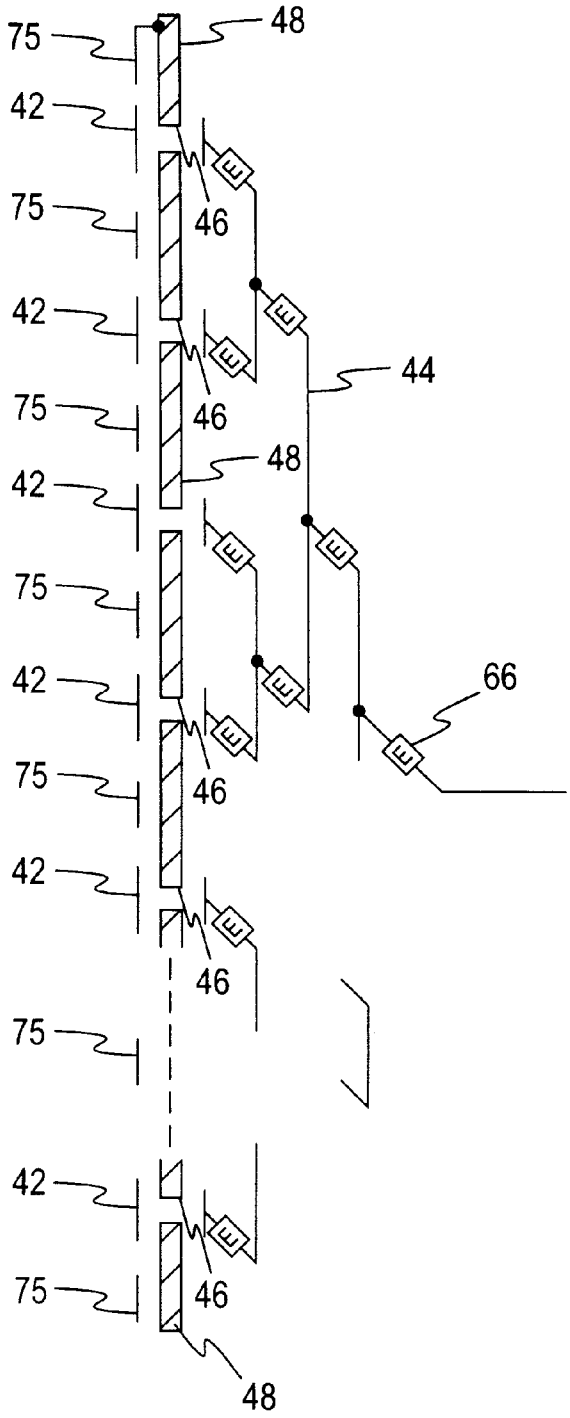
FIG. 8 is a side elevation, similar to FIG. 3, additionally showing the static drain lines etched onto a printed circuit board.

FIG. 8 shows a partial side sectional view of the patch antenna system, with lightning protection static drain lines 75, connected to ground. Thus, the absorbed DC or low frequency energy is directly ported to ground, rather than passing through the antenna (RF) apertures 46, to the stripline (or coaxial) feed lines 44, and then going through the sensitive electronics 66.

Figure 9:
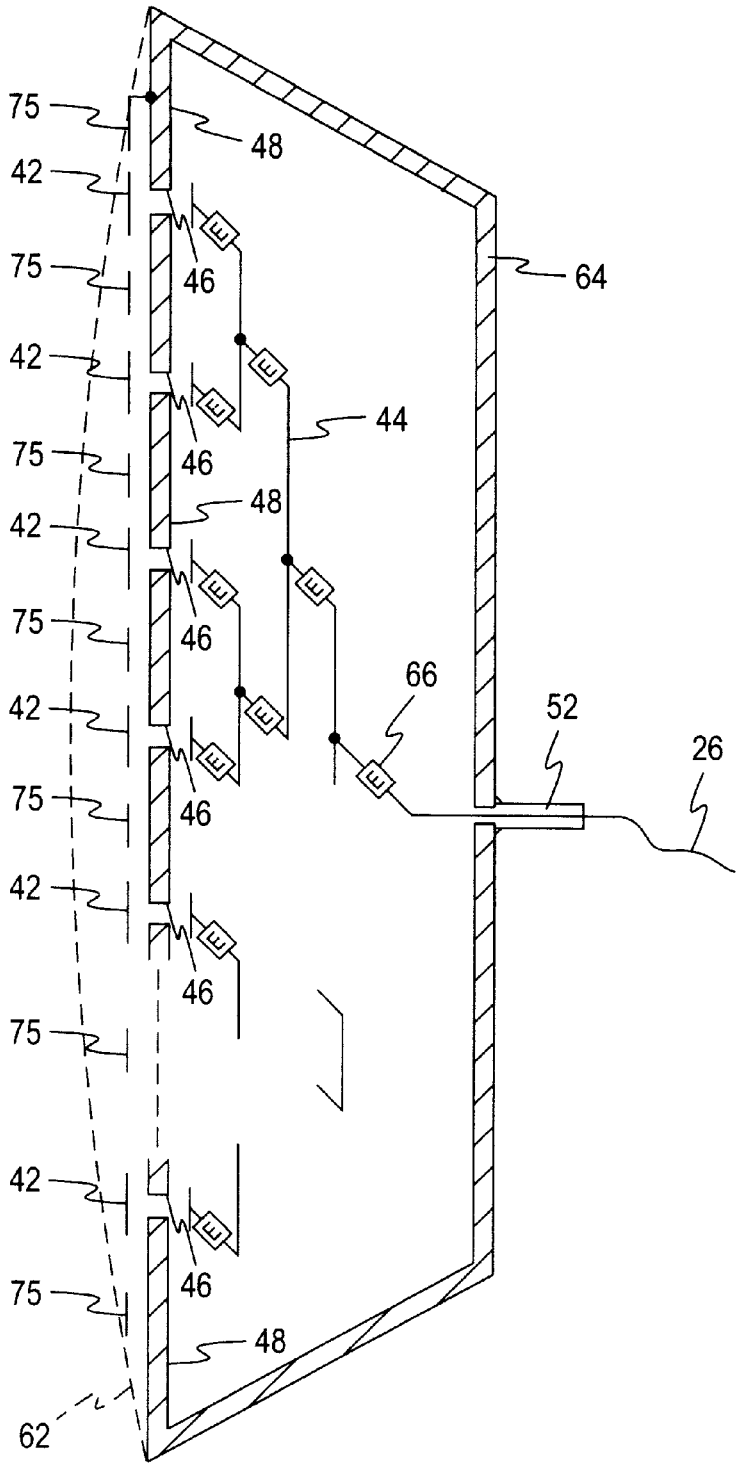
FIG. 9 is a side elevation, similar to FIG. 8, additionally showing a metal backplane or housing and a coaxial connector.

FIG. 9 shows a more complete system, in which all internal electronics 66 are now shielded from the lightning, corona, or static (low frequency or DC) energy. Here, the (metallic) ground plane 48 (with apertures 46) is directly connected to the (metallic) backplane 64 of the system. This backplane 64 is connected to an RF connector 52 for the coaxial cable 26 to the base station. The outer shield of the coaxial cable 26 shunts the energy to ground.

The backplane (or the antenna housing) 64, as well as the patch ground plane 48 are connected with each other and to form a "closed" area defining a Gaussian shield around all internal electronics. This is to ensure that no low frequency RF (at high voltage/power levels) can leak in and damage the sensitive electronics. There should not be any large holes (greater than about ½ inch), anywhere on the outer shield or shell (elements 48 and 64 in the embodiment of FIG. 9) of the system, that can "leak" low frequency or DC energy to the internal electronics. This "shell" further enhances the lightning protection arrangement for the sensitive internal electronic components 66. This shield or shell could also be made from metal mesh, with mesh size of less than 1/100 th of a wavelength.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. An active antenna system having lightning, corona and low frequency static energy protection, said system comprising:

a plurality of patch antenna elements;

a feed structure operatively interconnecting said plurality of patch antenna elements; and at least one conductive drain line coupled with each of said patch antenna elements, said drain lines being coupled together at a common ground connection point.

2. The system of claim 1 wherein said feed structure is a microstrip corporate feed, aperture-coupled with said plurality of patch antenna elements.

3. The system of claim 1 wherein said patch antenna elements are polarized in a given direction and wherein said drain line is coupled at or near an area of symmetry of each patch antenna element, said area of symmetry being an area at which radio frequency energy is relatively low with respect to the polarization direction of said patch antenna elements.

4. The system of claim 1 and further including a backplane, and wherein said drain lines are electrically coupled to said backplane.

5. The system of claim 1 and further including a ground plane and wherein said drain lines are electrically coupled to said ground plane.

6. The system of claim 1 and further including a coaxial connector operatively coupled with said feed structure and having a ground connector portion, and wherein said drain lines are electrically coupled to said ground connector portion.

7. The system of claim 1 wherein said patch antenna elements and said drain lines are carried on a dielectric substrate.

8. The system of claim 7 and further including grounding means for connecting said drain lines to ground.

9. The system of claim 1 and further including a second drain line coupled with each patch antenna element, said drain lines and said second drain lines being arranged symmetrically relative to said patch antenna elements.

10. The system of claim 7 and further including a second drain line coupled with each patch antenna element, said drain lines and said second drain lines being arranged symmetrically relative to said patch antenna elements.

11. The system of claim 1 and further including a backplane and a coaxial connector integrally mounted to said backplane.

12. The system of claim 11 and further including a ground plane electrically coupled with said backplane, said drain lines being electrically coupled with said ground plane.

13. The system of claim 12 wherein said ground plane has a plurality of apertures for coupling radio frequency energy between said patch antenna elements and said feed structure.

14. The system of claim 8 wherein said grounding means comprises a ground connector mounted to said dielectric substrate and electrically coupled with said drain lines.

15. The system of claim 8 wherein said grounding means comprises a ground wire electrically coupled to said drain lines.

16. The system of claim 7 and further including a ground plane, said dielectric substrate being spaced from, and generally parallel with said ground plane, and said drain lines being electrically coupled with said ground plane.

17. The system of claim 16 wherein said ground plane has a plurality of apertures for coupling radio frequency energy between said patch antenna elements and said feed structure.

18. The system of claim 16 and further including a conductive back plane, said ground plane being electrically coupled with said backplane and said backplane being electrically coupled to a ground connector of a cable connector.

19. The system of claim 18 wherein said conductive backplane and said ground plane form a Gaussian shield around said feed structure and any electronic devices and circuits coupled therewith.

20. The system of claim 19 wherein said backplane and said ground plane are formed of a metal mesh, with a mesh size of less than $1/100^{th}$ of a wavelength of the radio frequency to be transmitted or received by said patch antenna elements.

21. A method of providing lightning, corona and low frequency static energy protection for an active antenna system having a plurality of patch antenna elements and a feed structure operatively interconnecting said plurality of patch antenna elements, said method comprising:

coupling at least one conductive drain line with each of said patch antenna elements, and coupling said drain lines together at a common ground connection point.

22. The method of claim 21 wherein said patch antenna elements are polarized in a given direction and wherein said coupling includes coupling drain line at or near an area of symmetry of each patch antenna element, said area of symmetry being an area at which radio frequency energy is relatively low with respect to the polarization direction of said patch antenna elements.

23. The method of claim 21 and wherein said antenna system includes a backplane, and wherein said coupling includes coupling said drain lines electrically to said backplane.

24. The method of claim 21 wherein said antenna system includes a ground plane and wherein said coupling includes coupling said drain lines electrically to said ground plane.

25. The method of claim 21 including positioning said patch antenna elements and said drain lines on a dielectric substrate.

26. The method of claim 21 and further including connecting said common ground connection point to electrical ground.

27. The method of claim 21 and further including coupling a second drain line with each patch antenna element, and arranging said drain lines and said second drain lines symmetrically relative to said patch antenna elements.

28. The method of claim 27 including positioning said patch antenna elements and said drain lines on a dielectric substrate.

29. The method of claim 28 wherein said antenna system has a ground plane and further including locating said dielectric substrate spaced from and generally parallel with said ground plane, and said electrically coupling drain lines with said ground plane.

30. The method of claim 29 and further including forming a Gaussian shield around said feed structure and any electronic devices and circuits coupled therewith using a conductive backplane and said ground plane.

31. The method of claim 30 and further including forming said backplane and said ground plane of a metal mesh, with a mesh size of less than $1/100^{th}$ of a wavelength of the radio frequency to be transmitted or received by said patch antenna elements.

32. An active antenna system comprising:

a housing;

a plurality of antenna elements located in said housing;

one or more electronic components operatively coupled with one or more of said antenna elements and located in said housing, and a protection structure located in said housing for protecting said antenna elements and said one or more electronic components from lightning, corona and low frequency static energy.

33. The system of claim 32 wherein said antenna elements comprise patch antenna elements and including a feed structure interconnecting said patch antenna elements, and wherein said protection structure includes coupling at least one conductive drain line with each of said patch antenna elements, and coupling said drain lines together at a common ground connection point.

34. The system of claim 32 wherein said protective structure includes means forming a Gaussian shield around said feed structure and said one or more electronic components.

35. The system of claim 34 wherein said Gaussian shield is defined by a conductive backplane and a ground plane.

36. The system of claim 35 wherein said backplane and said ground plane are formed of a metal mesh, with a mesh size of less than $1/100^{th}$ of a wavelength of the radio frequency to be transmitted or received by said patch antenna elements.

37. The system of claim 33 wherein said patch antenna elements are polarized in a given direction and wherein said drain line is coupled at or near an area of symmetry of each patch antenna element, said area of symmetry being an area at which radio frequency energy is relatively low with respect to the polarization direction of said patch antenna elements.

38. The system of claim 37 and further including a second drain line coupled with each patch antenna element, said drain lines and said second drain lines being positioned symmetrically relative to said patch antenna elements.

* * * * *